United States Patent [19]

Takeda

[11] 3,984,954

[45] Oct. 12, 1976

[54] EXTERIOR WINDOW UNIT HAVING ADAPTER SILL PLATE

[75] Inventor: Hideichi Takeda, Ichikawa, Japan

[73] Assignee: Yoshida Kogyo Kabushiki Kaisha, Tokyo, Japan

[22] Filed: Dec. 19, 1975

[21] Appl. No.: 642,244

[30] Foreign Application Priority Data

Dec. 25, 1974 Japan ..... 50-4188[U]

[52] U.S. Cl. ..... 52/202; 49/63; 49/404; 52/211; 52/213; 160/90

[51] Int. Cl.[2] ..... E06B 3/26

[58] Field of Search..... 52/202, 204, 206, 209–214; 49/404, 409, 410, 411, 61, 63, 504; 160/90, 91

[56] References Cited

UNITED STATES PATENTS

| | | | |
|---|---|---|---|
| 1,866,882 | 7/1932 | Dixson | 49/63 X |
| 2,663,917 | 12/1953 | Peterson | 160/90 |
| 2,764,235 | 9/1956 | Renton | 160/91 |
| 2,960,734 | 11/1960 | Collins | 52/202 X |
| 3,226,779 | 1/1966 | Rust | 49/63 X |
| 3,295,277 | 1/1967 | Potter et al. | 52/211 |
| 3,694,961 | 10/1972 | Johnson | 49/504 X |

*Primary Examiner*—Alfred C. Perham
*Attorney, Agent, or Firm*—Hill, Gross, Simpson, Van Santen, Steadman, Chiara & Simpson

[57] ABSTRACT

An exterior window unit is adapted to cover an opening in a building wall. A frame sill of the unit has a mounting fin secured to a fixed sill in the building wall and having a first flange. An adapter sill plate is placed on and secured to the top surface of the fixed sill. The adapter sill plate has at its outer marginal edge a second flange which interfits with the first flange.

10 Claims, 3 Drawing Figures

EXTERIOR WINDOW UNIT HAVING ADAPTER SILL PLATE

BACKGROUND OF THE INVENTION

1. Field of the Invention

This invention relates to a window unit having an adapter sill plate for use in combination with an exisitng sill disposed in an opening in a building wall.

2. Prior Art

The type of exterior window units with which this invention is concerned provides a high degree of thermal insulation, air-tightness, and sound insulation since the units are mounted on the outside of openings in building walls, in which openings other window assemblies are normally present. The exterior window units of this kind have increasingly been used because they can retain a pleasing appearance of the preinstalled window assemblies having paper screen sashes (known as "Shoji" in Japan). The normally present or regular window assemblies have fixed frames made usually out of wood. Therefore, the sills of the fixed frames are prone to become worn rapidly when subjected to repeated sliding frictional movement thereon of the sashes. This has led to a drawback in that the frame sills of the exterior window units fail to fit dimensionally with the worn sills, and thus heretofore the latter must be replaced with new ones.

SUMMARY OF THE INVENTION

It is therefore a primary object of the invention to provide an adapter sill plate for use in combination with exterior window units, which plate will enable the units to be mounted on worn sills in building walls.

Another object of the invention is to provide an adapter sill plate which can mount frame sills of exterior window units firmly on fixed sills in building walls.

According to the invention, there is provided an adapter sill plate mounted on the top surface of a fixed sill in a building wall. The sill plate has a pair of grooves in and along which a pair of sashes are movable. The adapter sill plate has at its outer marginal edge a flange which is complementary in shape to and is engagable with a flange provided at the top end of a mounting fin for a frame sill of an exterior window unit.

Many other advantages and features of the present invention will become manifest to those versed in the art upon making reference to the detailed description and the accompanying sheets of drawings in which preferred structural embodiments incorporating the principles of the present invention are shown by way of illustrative example.

DETAILED DESCRIPTION OF THE PREFERRED EMBODIMENTS

Figure 1:
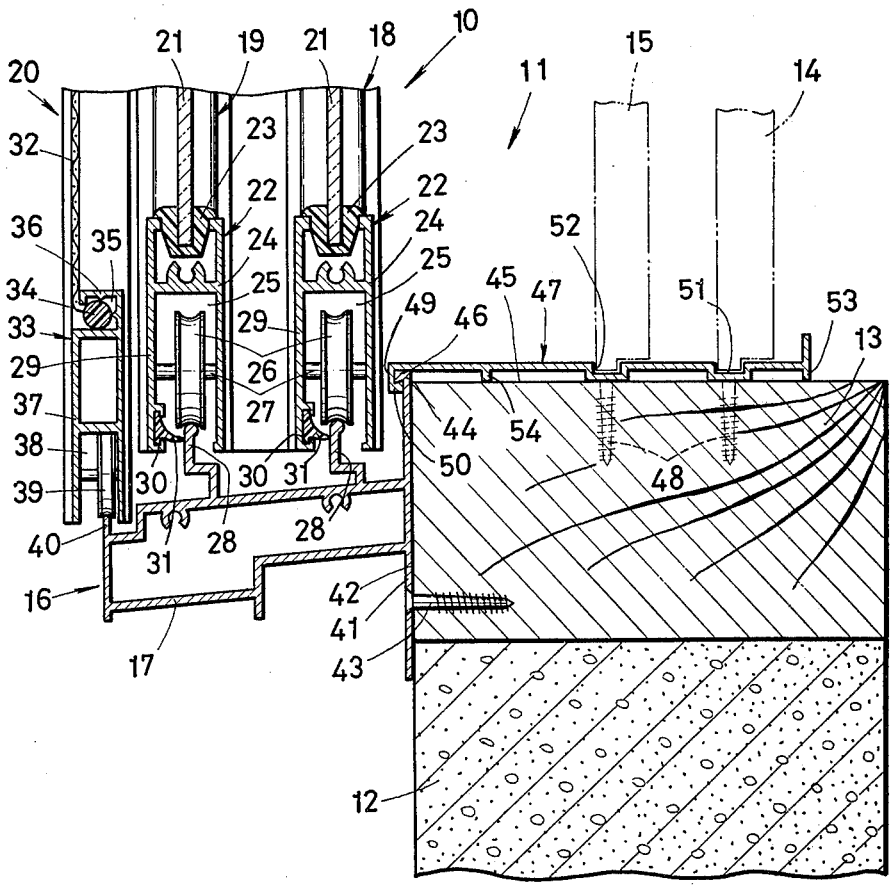
FIG. 1 is a fragmentary vertical cross-sectional view through an exterior window unit having a frame sill cooperating with an adapter sill plate provided in accordance with the invention.

FIG. 1 shows an exterior window unit 10 mounted on the exterior of a building wall 12 and covering an opening 11 therein. The wall 12 has a wooden fixed sill 13 on which a pair of spaced, inner sashes 14, 15 are normally mounted for horizontal sliding movement.

The exterior window unit 10 broadly comprises a frame 16 made preferably of extruded aluminum and including a sill 17, a pair of relatively movable sashes 18, 19 of the rolling type mounted within the frame 16 in parallel closely spaced planes, and a screen sash 20 spaced outwardly of the sashes 18, 19 and mounted for horizontal rolling movement on the frame sill 17.

Each of the sashes 18, 19 includes a glass pane 21 and a frame 22 extending around the pane 21, a sealing strip or gasket 23 being therebetween. The frame 22 has a bottom rail 24 including a downwardly opening channel 25 in which there is a roller 26 rotatably supported on a shaft 27, the roller 26 being in rolling engagement with an upwardly extending flange 28 formed integrally with the frame sill 17. An outer wall 29 of the channel 25 has at its bottom end an inwardly opening lipped groove 30 extending the entire length of the rail 24 and receiving a sealing strip or gasket 31 having a distal edge slidably engaging the flange 28.

The screen sash 20 comprises a screen 32 and a frame 33 embracing the periphery of the screen 32, the screen being maintained tautly by an elongated retainer 34 which together with the screen periphery is snapped into an outwardly opening channel 35 provided by a flange 36 formed integrally with the frame 33. The frame 33 includes a bottom rail 37 having a downwardly opening channel 38 in which a roller 39 is rotatably mounted for rolling engagement with an upwardly extending flange 40 formed integrally with the fixed frame 16. The screen 32 has such a fine mesh that it will prevent the admission of dust into the building through the exterior window unit 10 when one of the sashes 18, 19 is open.

The frame sill 17 has a vertical mounting fin 41 formed integrally therewith and fixed to an exterior vertical surface 42 of the sill 13 by a number of wood screws 43 which are threaded through a lower part of the mounting fin 41 into the sill 13. The mounting fin 41 extends horizontally along the entire length of the sill 13.

The mounting fin 41 has an upper edge 44 projecting upwardly beyond the top surface 45 of the sill 13 and directed outwardly to provide an outwardly projecting flange 46. An adapter sill plate 47 made preferably of extruded aluminum substantially covers the top surface 45 and is secured thereto by a number of wood screws 48. The adapter sill plate 47 extends along the entire length of the sill 13 and has an outwardly and downwardly extending flange 49 of which the lower edge is directed inwardly around the outwardly projecting flange 46 in the form of an inwardly projecting flange 50. The inwardly projecting flange 50 has a locking taper complementary in shape to the outwardly projecting flange 46. The adapter sill plate 47 has a pair of longitudinally extending parallel grooves 51, 52 adapted to receive therein the sliding inner sashes 14, 15, respectively. The adapter sill plate 47 has a pair of longitudinally extending flanges 53, 54 projecting downwardly against the top surface 45. The flanges 53, 54 project by a distance by which the fin top edge 44 extends beyond the top surface 45 so that a major portion of the protective sill plate 47 is spaced upwardly of and lies parallel to the top surface 45. If desired, analogous ridges may be provided on the lower side of the sill 17 for further supporting it on a surface, not shown, or as shown in FIG. 3.

When the exterior window unit 10 is to be installed, the frame sill 17 is interfitted with the adapter sill plate 47 and the sill 17 is brought into abutment against and is secured to the vertical exterior surface 42 by a number of the wood screws 43. Then, the adapter sill plate 47, interfitted with the fin top edge 44, is placed over the sill top surface 45. The plate 47 is moved inwardly until the flanges 46 and 50 engage snugly with each other, whereupon the wood screws 48 are threaded through the plate 47 into the sill 13 so as to connect the sill plate 47 securely to the sill 13. Thus, the frame sill 17 can be mounted fixedly in position on the sill 13 on account of the flanges 46, 50 being interengaged with each other. The adapter sill plate 47 provides a raised top surface for the worn sill 13 so that the frame sill 17 can be mounted neatly on the sill 13. Furthermore, the adapter sill plate 47 covering the sill 13 prevents the top surface 45 from being further worn away by frictional engagement with the sliding inner sashes 14, 15.

Figure 2:
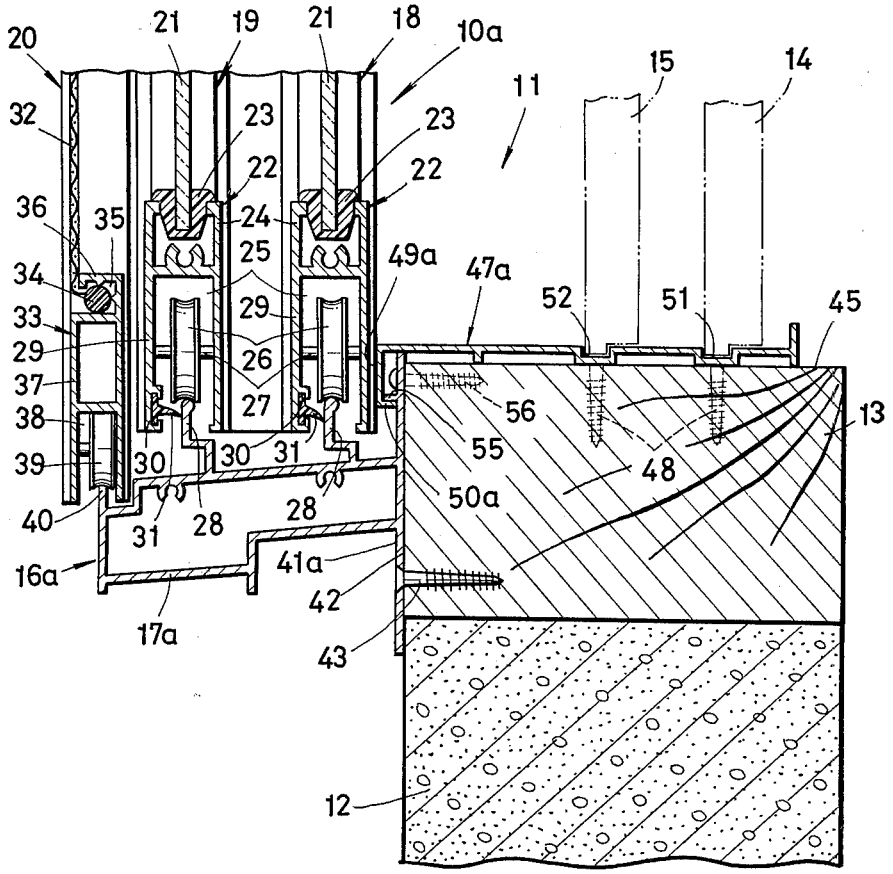
FIGS. 2 and 3 are views similar to FIG. 1 but showing modified adapter sill plates.

According to a modified form of the invention shown in FIG. 2, a mounting fin 41*a* has adjacent to its top edge an outwardly extending flange 55. An adapter sill plate 47*a* has an outwardly and downwardly extending flange 49*a*, the lower edge of which is formed inwardly around the flange 55 to provide an inwardly projecting flange 50*a*. For installation of the exterior window unit 10*a*, the mounting fin 41*a* is secured to the vertical exterior surface 42 by the wood screw(s) 43 passing through a lower part of the fin 41*a* and by a wood screw(s) 56 passing through an upper part of the fin 41*a* which extends upwardly from the flange 55. Then the adapter sill plate 47*a* is placed over the sill 13 to engage the flange 50*a* with the flange 55. The adapter sill plate 47*a* is secured to the sill 13 by means of the wood screws 48.

Figure 3:
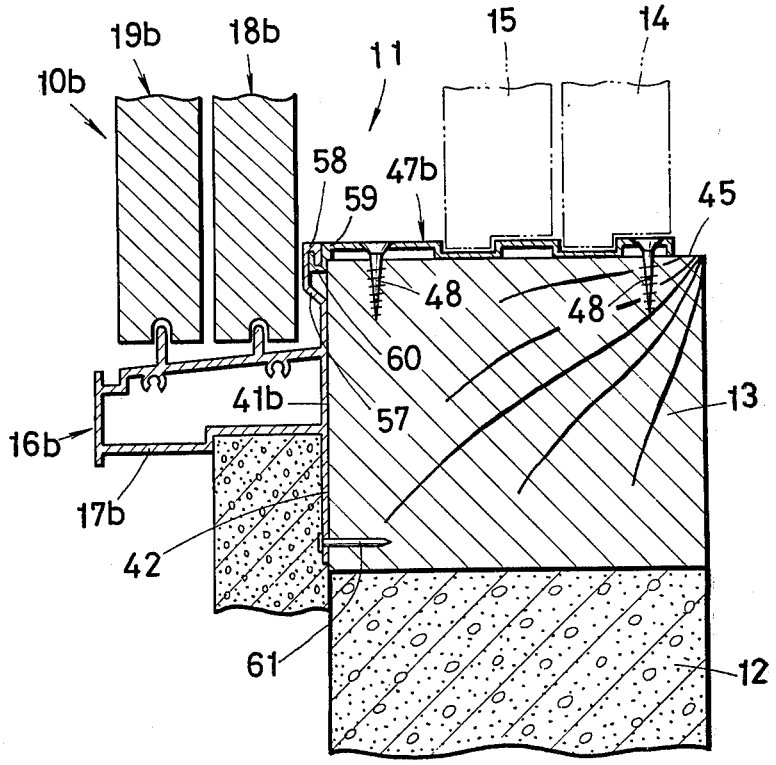

As shown in FIG. 3, another modification of the invention comprises a mounting fin 41*b* having its upper marginal portion 57 spaced outwardly of the exterior surface 42. The edge of the marginal portion 57 is directed inwardly and downwardly to provide a crosssectionally hook-shaped flange 58. An adapter sill plate 47*b* has its outer marginal edge also formed into a cross-sectionally hook-shaped flange 60 which is complementary in shape to the flange 58. When the frame sill 17*b* is to be mounted on the sill 13, the adapter sill plate 47*b* is first affixed to the sill 13 by means of the wood screws 48. The mounting fin 41*b* is then attached to the vertical exterior surface 42 so that the flanges 58, 60 interengage. The mounting fin 41*b* is then secured to the sill 13 by a nail 61 or other suitable fastening means, after which additional concrete can be poured, if desired.

Although various minor modifications may be suggested by those versed in the art, it should be understood that I wish to embody within the scope of the patent warranted hereon, all such embodiments as reasonably and properly come within the scope of my contribution to the art.

I claim as my invention:

1. An exterior window unit for covering an opening in a building wall, the opening having a first sill, said exterior window unit comprising:

a. a frame having a second sill;

b. a pair of sashes mounted within said frame in parallel closely spaced planes;

c. mounting means on said second sill and adapted to be attached to a vertical exterior surface of the first sill, said mounting means having first engaging means extending along its upper edge; and d. a plate member for extending along the length of the first sill, said plate member being adapted to be secured to a horizontal surface of the first sill and having second engaging means at its outer edge interengaging said first engaging means.

2. An exterior window unit according to claim 1, in which one of said engaging means includes an outwardly extending flange, and the other of said engaging means includes an inwardly extending flange, said outwardly extending flange and said inwardly extending flange overlappingly engaging each other.

3. An exterior window unit according to claim 1, in which said first engaging means and said second engaging means include cross-sectionally hook-shaped flanges, respectively, which are complementary in shape to and interengage with each other.

4. An exterior window unit according to claim 1, in which said first and second engaging means are cross-sectionally complemental and interlock with each other.

5. An exterior window unit according to claim 1, in which said plate member has a pair of upwardly opening grooves extending along its length slidably receptive of a further pair of sashes.

6. An exterior window unit according to claim 1, in which said plate member has longitudinal ridges on its lower surface by which the major portion of said plate member is spaced upwardly from the first sill.

7. Means for supporting window sashes adjacent to a sill, said means comprising:

a. a frame adapted to support the sashes and having a second sill;

b. mounting means on said second sill and adapted to be attached to a vertical exterior surface of the first sill, said mounting means having first engaging means extending along its upper edge; and c. a plate member for extending along the length of the first sill, said plate member being adapted to be secured to a horizontal surface of the first sill and having second engaging means at its outer edge interengaging said first engaging means.

8. An exterior window unit according to claim 7, in which one of said engaging means includes an outwardly extending flange, and the other of said engaging means includes an inwardly extending flange, said outwardly extending flange and said inwardly extending flange overlappingly engaging each other.

9. An exterior window unit according to claim 7, in which said plate member has a pair of upwardly opening grooves extending along its length slidably receptive of a further pair of sashes.

10. An exterior window unit according to claim 7, in which said plate member has longitudinal ridges on its lower surface by which the major portion of said plate member is spaced upwardly from the first sill.

* * * * *